US010611590B2

(12) United States Patent
Yokoyama

(10) Patent No.: US 10,611,590 B2
(45) Date of Patent: Apr. 7, 2020

(54) MEDIUM FEED UNIT AND IMAGE FORMING APPARATUS

(71) Applicant: Oki Data Corporation, Tokyo (JP)

(72) Inventor: Naotake Yokoyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 461 days.

(21) Appl. No.: 15/649,237

(22) Filed: Jul. 13, 2017

(65) Prior Publication Data

US 2018/0016109 A1 Jan. 18, 2018

(30) Foreign Application Priority Data

Jul. 14, 2016 (JP) ..... 2016-139383

(51) Int. Cl.

| | |
|---|---|
| ***B65H 16/10*** | (2006.01) |
| ***B65H 20/02*** | (2006.01) |
| ***G03G 15/00*** | (2006.01) |
| *B41J 15/16* | (2006.01) |
| *B41J 15/04* | (2006.01) |

(52) U.S. Cl.

CPC ..... *B65H 20/02* (2013.01); *B65H 16/10* (2013.01); *G03G 15/652* (2013.01); *G03G 15/6529* (2013.01); *B41J 15/04* (2013.01); *B41J 15/16* (2013.01)

(58) Field of Classification Search

None

See application file for complete search history.

(56) References Cited

U.S. PATENT DOCUMENTS 2,027,796 A * 1/1936 Swift, Jr. ..... B65H 20/02 425/369
3,602,452 A * 8/1971 Sauer ..... B65H 23/08 242/421.8
3,963,191 A * 6/1976 Goodley ..... B65B 13/18 242/417.3
4,231,560 A * 11/1980 Stohlquist ..... B65B 41/16 226/37
4,433,816 A * 2/1984 Rousseau ..... B23K 9/1333 226/189
2012/0155946 A1* 6/2012 Colonel ..... B41J 11/0025 400/691
2012/0301186 A1* 11/2012 Yang ..... G03G 15/652 399/121

FOREIGN PATENT DOCUMENTS

JP 2012-201490 A 10/2012

* cited by examiner

*Primary Examiner* — Jill E Culler

(74) *Attorney, Agent, or Firm* — Muncy, Geissler, Olds & Lowe, P.C.

(57) ABSTRACT

A medium feed unit in an image forming apparatus having an image forming unit and feeds a medium to the image forming unit, includes a medium introductory part that includes a first shaft and a medium feed part that includes a second shaft feeds the medium to the medium introductory part; a fixation part that includes a first holding part holding the first shaft and a second holding part holding the second shaft; and a link member that links the first shaft with the second shaft and is displaceable with respect to the fixation part. A first inclination angle of the first shaft with respect to the fixation part varies in accordance with a variation of a second inclination angle of the second shaft with respect to the fixation part.

10 Claims, 10 Drawing Sheets

(Interconnect Status)

(Separation Status)

(Operation Status)

(Set Status)

MEDIUM FEED UNIT AND IMAGE FORMING APPARATUS

CROSS REFERENCE TO RELATED APPLICATIONS

This application claims priority under 35 USC 119 to Japanese Patent Application No. 2016-139383 filed on Jul. 14, 2016 original document, the entire contents which are incorporated herein by reference.

TECHNICAL FIELD

The present invention relates to an image forming apparatus that forms images using an electrographic system, and a medium feed unit installed in the apparatus.

BACKGROUND

There has been proposed a printer (image forming apparatus) having a medium feed unit that forwards roll paper and an image forming unit that prints images on the forwarded roll paper (for example, see Patent Literature 1).

RELATED ART

[Patent Literature 1] JP 2012-201490 A

In such a printer, a travel direction and tension of roll paper forwarded from a medium feed unit are required not to greatly vary.

Therefore, it is preferable to provide a medium feed unit capable of feeding a medium more stably, and an image forming apparatus having such a medium feed unit.

SUMMARY

A medium feed unit that is to be installed in an image forming apparatus having an image forming unit and feeds a medium, which is fed from a medium roll, to the image forming unit, the medium feed unit, comprising a medium introductory part that includes a first shaft and introduces the medium to the image forming unit; a medium feed part that includes a second shaft around which the medium roll rotates and feeds the medium to the medium introductory part; a fixation part that includes a first holding part holding the first shaft and a second holding part holding the second shaft; and a link member that links the first shaft with the second shaft and is displaceable with respect to the fixation part such that a first inclination angle (θ2) of the first shaft with respect to the fixation part varies in accordance with a variation of a second inclination angle (θ1) of the second shaft with respect to the fixation part.

An image forming apparatus that is one embodiment of the invention is to be provided with an image forming unit and the medium feed unit discussed above to feed a medium to the image forming unit.

In the medium feed unit and the image forming apparatus that are embodiments of the invention, the first inclination angle (θ2) of the first shaft with respect to the fixation part is configured to vary in accordance with a variation of the second inclination angle (θ1) of the second shaft with respect to the fixation part. Thereby, in a section between the medium feed part and the medium introductory part, a tension, which is generated toward a carrying direction of the medium, becomes stable with respect to a width direction that is perpendicular to the carrying direction of medium.

With the medium feed unit and the image forming apparatus according to an embodiment of the invention, skewing of a forwarded medium is limited, which makes it possible to feed a medium more stably.

BRIEF DESCRIPTIONS OF THE DRAWINGS

DETAILED DESCRIPTIONS OF THE PREFERRED EMBODIMENT(S)

Figure 1:
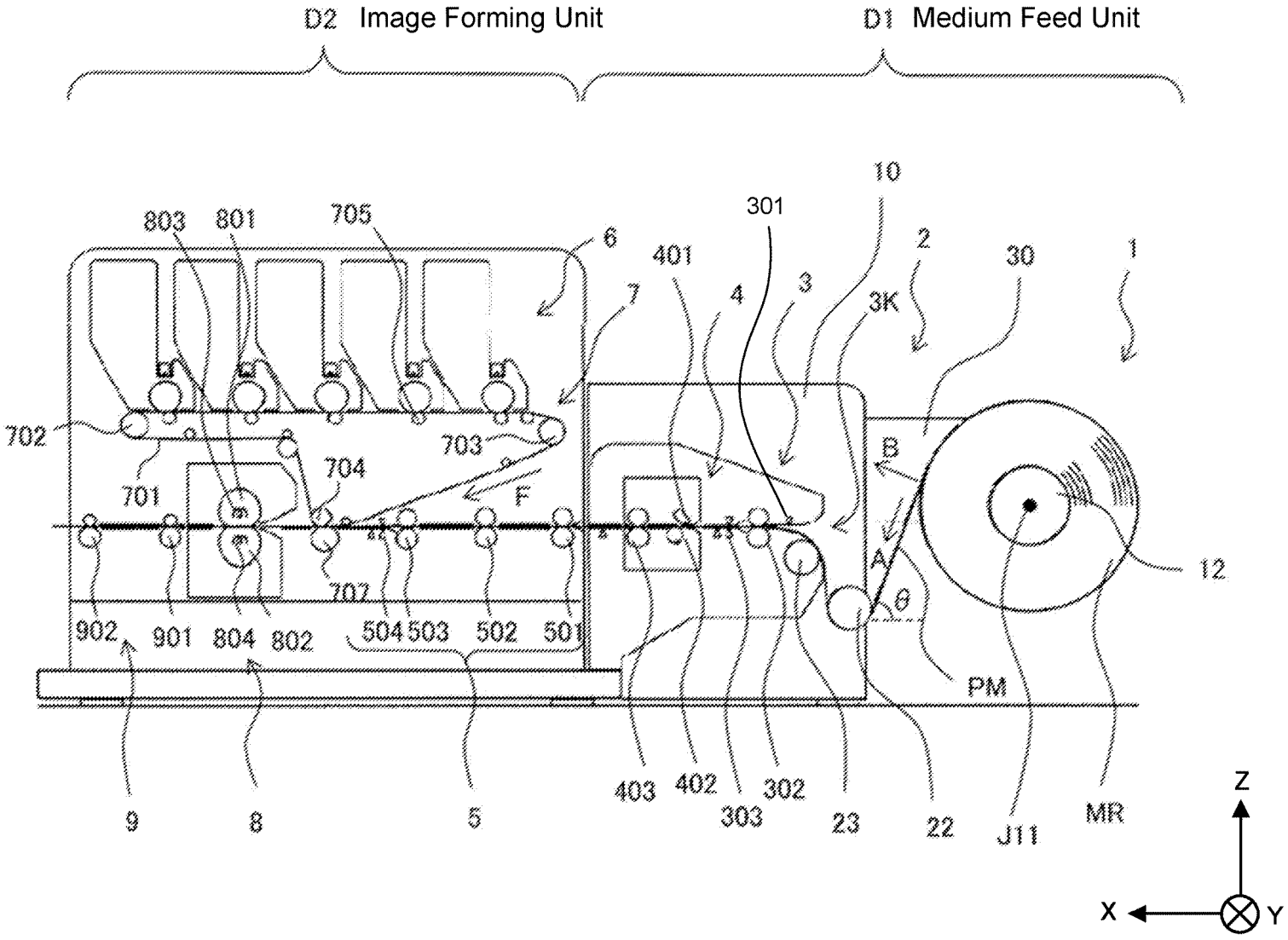
FIG. 1 is a schematic view showing an example of the whole configuration of an image forming apparatus according to an embodiment of the invention.

Below, an embodiment of the image forming apparatus by this invention is explained referring to drawings. It should be noted that the following explanation is one specific example and the invention is not limited to the embodiment described below. For the arrangement, size, size ratio and the like of constituent elements shown in the drawings, the invention is also not limited to the illustrated example. The explanation is made in the following order.

1. Embodiment: Image forming apparatus having a medium feed unit for feeding a roll paper
2. Alternative examples

1. EMBODIMENT

Outline Configuration

FIG. 1 is a schematic view showing an example of the whole configuration of an image forming apparatus according to an embodiment of the invention. The image forming apparatus is an electrographic printer that forms images (e.g., color images) on, for instance, a medium (also caller paper, a recording medium, a printing medium, or a transfer material) PM.

The image forming apparatus includes a medium feed unit D1 and an image forming unit D2 as shown in FIG. 1. The medium feed unit D1 is a mechanism that rotatably holds a roll (winding structure) formed by winding the medium PM that is an object on which an image is formed, and forwards the medium PM toward the downstream image forming unit D2 in printing operation. The medium feed unit D1 corresponds to a specific example of a "medium feed unit" of the invention. The image forming unit D2 transfers and fuses a developer image (toner image) onto the medium pm fed from the medium feed unit D1. The image forming unit D2 corresponds to a specific example of an "image forming unit" of the invention.

The medium feed unit D1 has, for example, a medium feed part 1, a medium introductory part 2, a medium carrying part 3 and a medium cutting part 4 in order from the upstream to the downstream. The image forming unit D2 has a write-in timing adjustment carrying part 5, an image forming part 6, an intermediate transfer unit 7, a fuser part 8 and an ejection carrying part 9 in order from the upstream to the downstream.

The medium PM fed from the medium feed part 1 is carried through, in sequence, the medium introductory part 2, the medium carrying part 3, the medium cutting part 4, the write-in timing adjustment carrying part 5, the image forming part 6, the intermediate transfer unit 7, the fuser part 8 and the ejection carrying part 9. In the specification, in a traveling direction of the medium PM, the position close to the medium feed part 1 that is a feed source of the medium PM when viewed from a given position is defined as upstream, and the position distant from the medium feed part 1 is defined as downstream. In the specification, the direction perpendicular to the traveling direction of the medium PM (direction perpendicular to the paper plane of FIG. 1) is called a width direction.

The medium feed part 1 holds the roll MR and feeds the medium PM toward the medium introductory part 2, and the medium introductory part 2 introduces the medium PM forwarded from the roll MR of the medium feed part 1 to the image forming unit D2. The detailed configurations of the medium feed part 1 and the medium introductory part 2 are described later.

The medium carrying part 3 is provided with, for example, a leading edge detection sensor 301, a forwarding roller pair 302 and a leading edge detection sensor 303 in order from the upward to the downward. The leading edge detection sensors 301 and 303 are position detection sensors for detecting the leading edge of the medium PM. The forwarding roller pair 302 starts operating to forward the medium M downstream upon detection of the medium PM by the leading edge detection sensor 301.

The medium cutting part 4 has a fixed blade 401, a rotating blade 402 and a roller pair 403. In the medium cutting part 4, the rotating blade 402 is rotated in a predetermined direction with respect to the fixed blade 401 such that the medium PM is cut at a predetermined length. The roller pair 403 uses its rotation to carry the medium PM The write-in timing adjustment carrying part 5 located downstream of the medium cutting part 4 forwards the medium PM while adjusting the timing with a secondary transfer roller 707 (described later) in the intermediate transfer unit 7. The write-in timing adjustment carrying part 5 has, for instance, timing adjustment roller pairs 501 to 503 and a leading edge detection sensor 504 in order from the upstream. The timing adjustment roller pairs 501 to 503 are members that carry the medium PM while adjusting the carrying rate and the timing. The leading edge detection sensor 504 is a sensor that detects the position of the leading edge of the carried medium PM.

The image forming part 6 is positioned above the intermediate transfer unit 7 and has development devices that form toner images of respective colors. The image forming part 6 forms the toner images of respective colors on a surface of an intermediate transfer belt 701 (described later) of the intermediate transfer unit 7 using the electrographic system.

The intermediate transfer unit 7 has, for instance, the intermediate transfer belt 701, a drive roller 702, a tension roller 703, a secondary transfer backup roller 704, a primary transfer roller 705 and a secondary transfer roller 707. The intermediate transfer belt 701 is an endless elastic belt made of a resin material such as a polyimide resin. The intermediate transfer belt 701 is strained (stretched) by means of the drive roller 702, the tension roller 703, the secondary transfer backup roller 704 and the like. The drive roller 702 is a member that is driven by a drive motor and causes the intermediate transfer belt 701 to rotate in a predetermined carrying direction F. The tension roller 703 is a driven roller that follows rotation of the intermediate transfer belt 701 and serves to impart tension to the intermediate transfer belt 701 using an bias force from an bias member such as a coil spring. The primary transfer roller 705 is disposed to face the image forming part 6 across the intermediate transfer belt 701, and applies a predetermined voltage when a toner image formed by the developer device is transferred to the surface of the intermediate transfer belt 701. The secondary transfer backup roller 704 and the secondary transfer roller 707 are disposed to face each other across the intermediate transfer belt 701 on the opposite side from the image forming part 6 (under the intermediate transfer unit 7), thus forming a secondary transfer part. The secondary transfer backup roller 704 and the secondary transfer roller 707 serve to secondarily transfer the toner image, which has been primarily transferred to the surface of the intermediate transfer belt 701, to the medium PM. In secondary transfer of a toner image to the medium PM, the intermediate transfer unit 7 uses the function of the write-in timing adjustment carrying part 5 to synchronize the transfer with formation of a toner image on the intermediate transfer belt 701.

The fuser part 8 is disposed downstream of the intermediate transfer unit 7. The fuser part 8 applies heat and pressure to the toner image having been transferred to the medium PM carried from the secondary transfer part that is composed of the secondary transfer backup roller 704 and the secondary transfer roller 707, and melts the toner image to fuse it to the medium PM. The fuser part 8 has a pair of rollers 801 and 802 that are contacted and pressed against each other with a predetermined pressure, a heat source 803 that is disposed inside the roller 801 to heat the roller 801, and a heat source 804 that is disposed inside the roller 802 to heat the roller 802. The heat sources 803 and 804 are for example halogen lamps.

The ejection carrying part 9 is disposed downstream of the fuser part 8 and has carrying roller pairs 901 and 902. The carrying roller pairs 901 and 902 eject the medium PM carried from the fuser part 8 to the outside of the image forming unit D2.

Configuration of Medium Feed Part 1 and Medium Introductory Part 2

Figure 2:
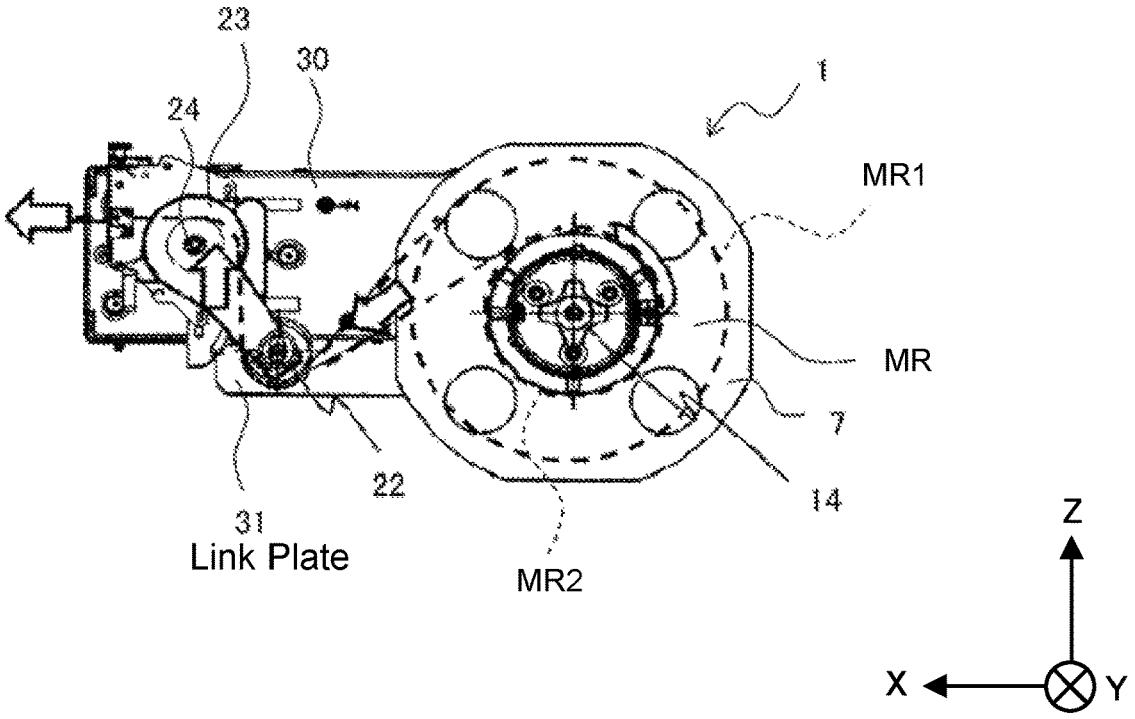
FIG. 2 is a front view showing the appearance of a medium feed unit shown in FIG. 1.
Figure 3:
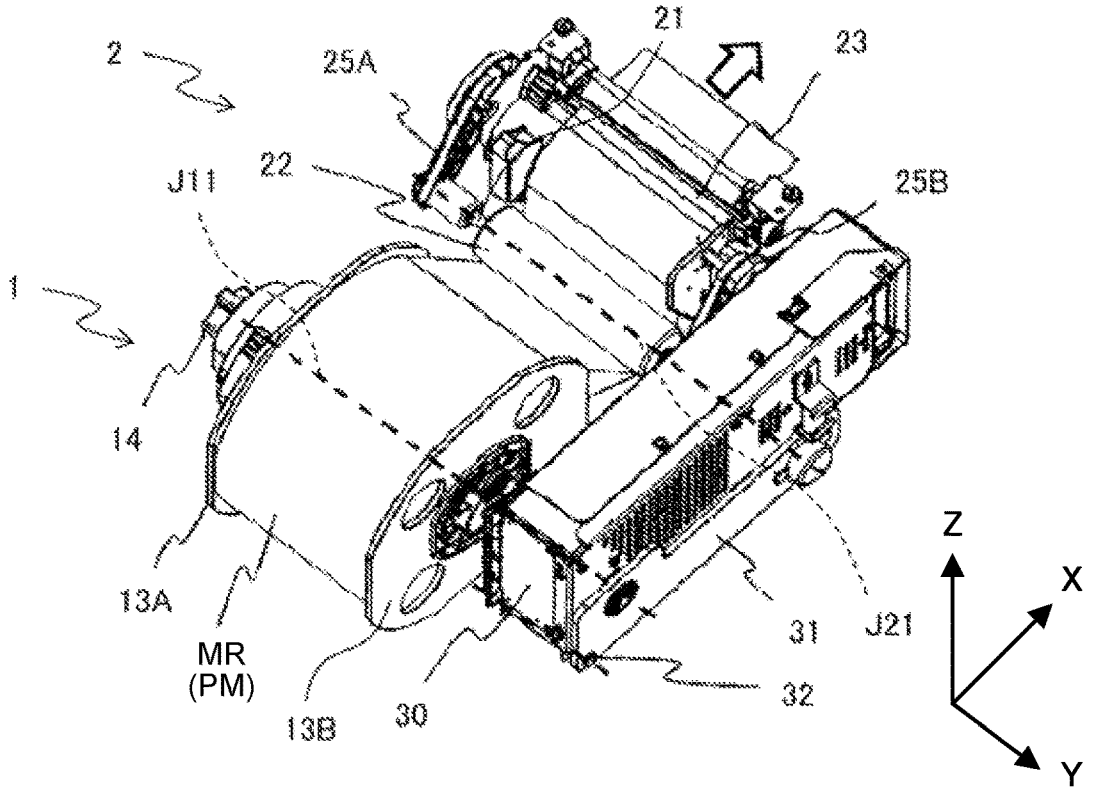
FIG. 3 is a perspective view showing the appearance of the medium feed unit shown in FIG. 1.
Figure 4:
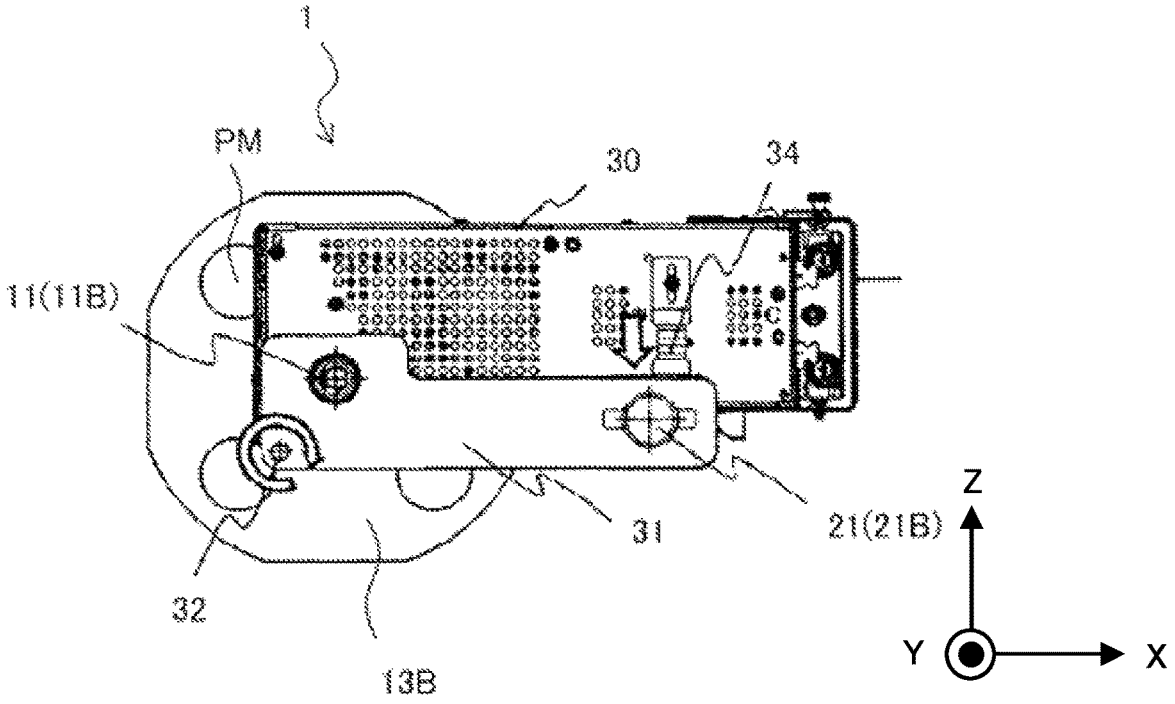
FIG. 4 is a rear view showing the appearance of the medium feed unit shown in FIG. 1.
Figure 5A:
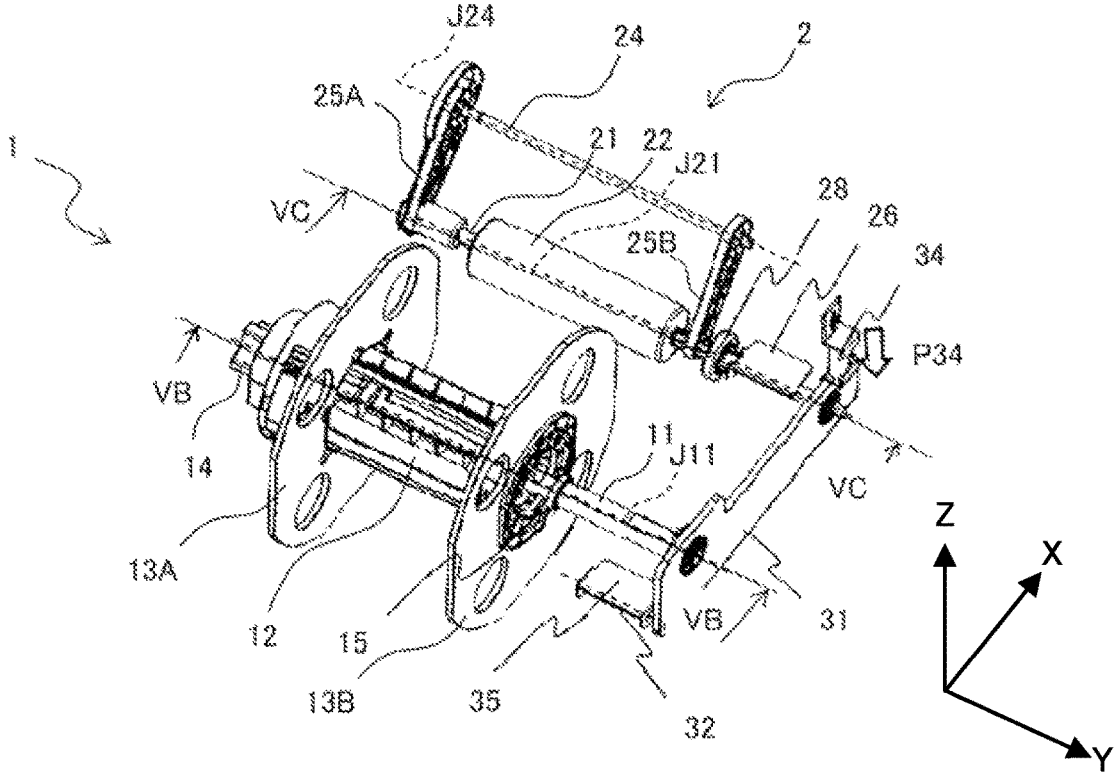
FIG. 5A is a perspective view showing an important portion of the medium feed unit shown in FIG. 1.
Figure 5B:
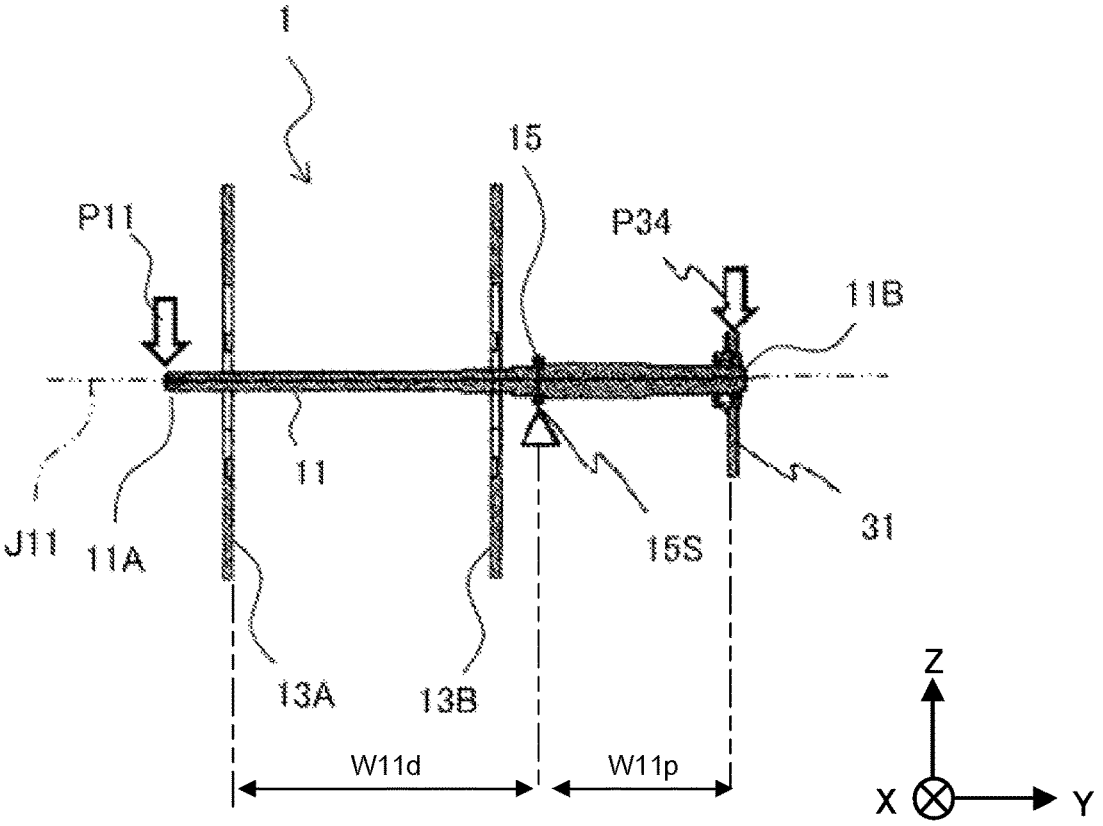
FIG. 5B is a side view showing a medium feed part and the surrounding portion thereof in the medium feed unit shown in FIG. 1.
Figure 5C:
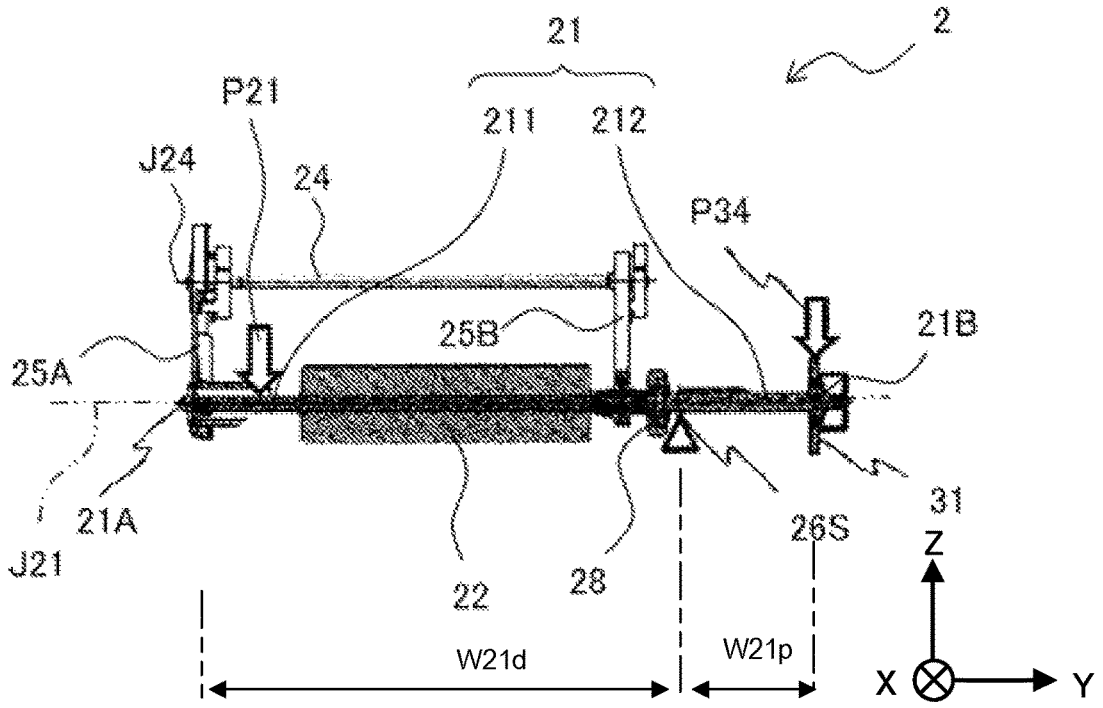
FIG. 5C is a side view showing a medium introductory part and the surrounding portion thereof in the medium feed unit shown in FIG. 1.
Figure 6A:
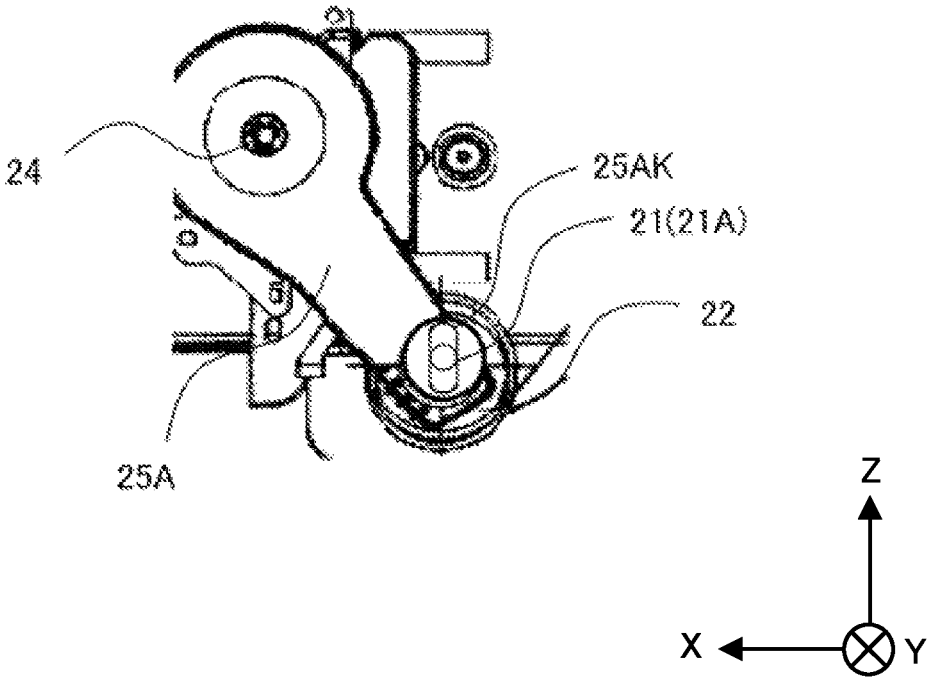
FIG. 6A is a front view showing an important portion of the medium introductory part shown in FIG. 1.
Figure 6B:
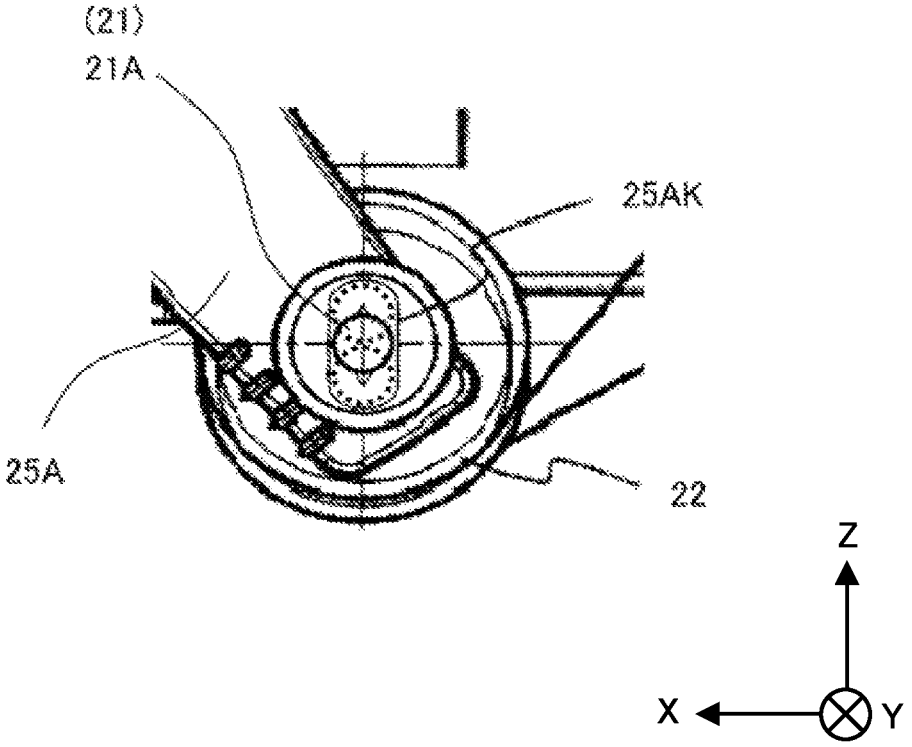
FIG. 6B is an enlarged front view showing the important portion of the medium introductory part shown in FIG. 6A.
Figure 7A:
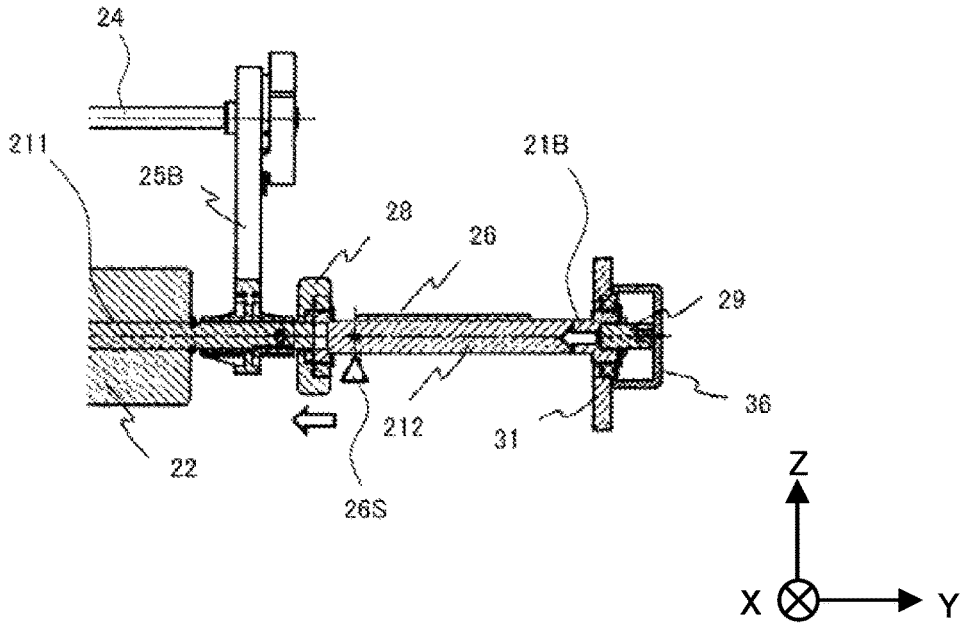
FIG. 7A is a side view showing an important portion of the medium introductory part shown in FIG. 1.
Figure 7B:
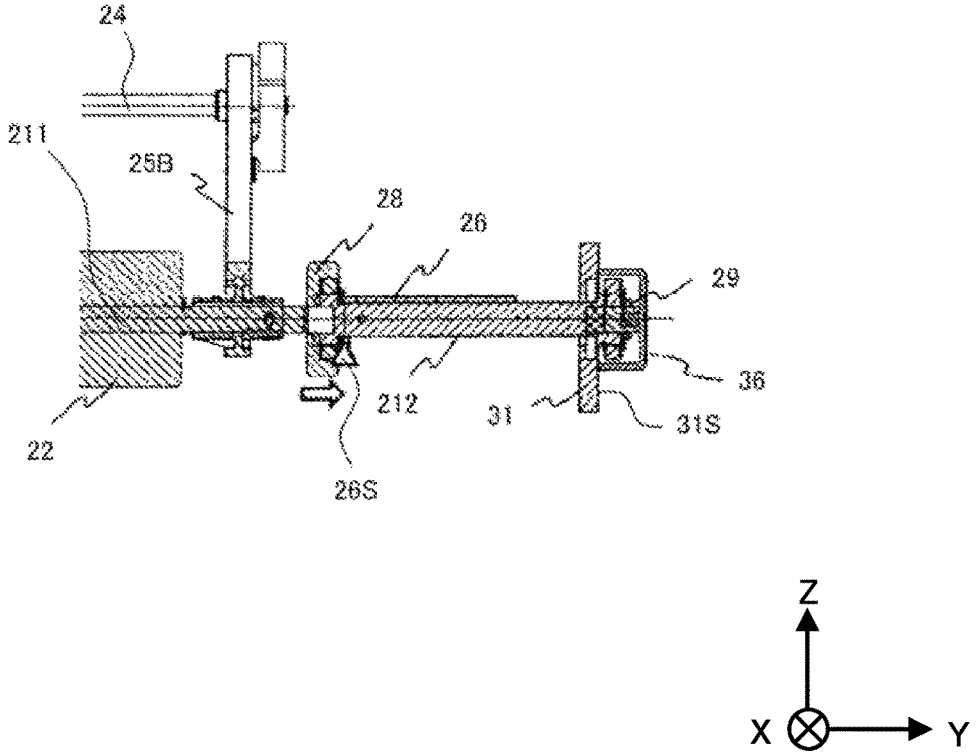
FIG. 7B is another side view showing the important portion of the medium introductory part shown in FIG. 1.
Figure 7C:
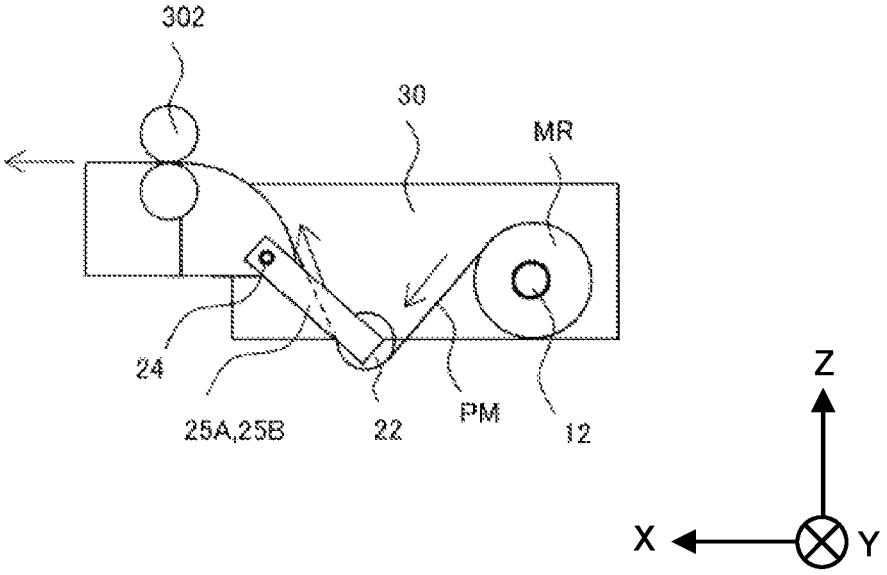
FIG. 7C is a schematic view for illustrating the position of the medium introductory part shown in FIG. 1 during operation.
Figure 7D:
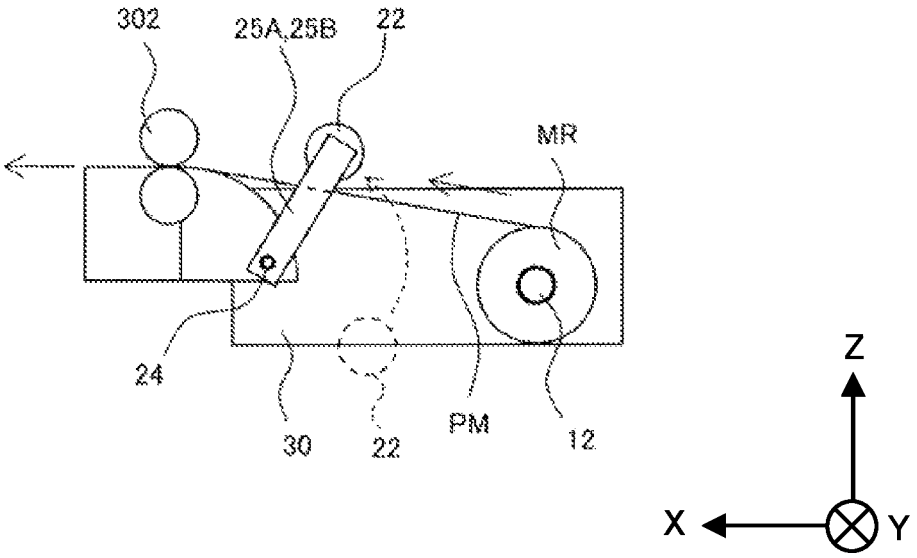
FIG. 7D is a schematic view for illustrating the position of the medium introductory part shown in FIG. 1 when it is stopped.

Next, the configurations of the medium feed part 1 and the medium introductory part 2 are explained in detail with reference to FIGS. 2 to 7D. FIGS. 2 to 4 are respectively a front view, perspective view and rear view showing the appearance of an important portion of the medium feed unit D1 with the roll MR being installed. FIG. 5A is a perspective view showing the appearance of an important portion of the medium feed unit D1 with the roll MR being not installed. FIG. 5B is a cross-sectional view taken along line VB-VB shown in FIG. 5A, and FIG. 5C is a cross-sectional view taken along line VC-VC shown in FIG. 5A. FIG. 6A is a front view showing an important portion of the medium introductory part 2. FIG. 6B is an enlarged front view showing the important portion of the medium introductory part 2. FIG. 7A is a cross-sectional view showing a first state at another important portion of the medium introductory part 2, FIG. 7B is a cross-sectional view showing a second state at the important portion of the medium introductory part 2. FIG. 7C is an explanatory view showing the position of the medium introductory part 2 during operation of the image forming apparatus, and FIG. 7D is an explanatory view showing the position of the medium introductory part 2 during set (medium is not carried) of the image forming apparatus.

As shown in FIG. 5A, The medium feed part 1 holds the roll MR and feeds the medium PM to the medium introductory part 2, and has a shaft 11, a holder 12, guide plates 13A and 13B, a lock 14 and a bearing 15. The shaft 11 extends in the width direction (or Y direction) and is held by the bearing 15, which is fixed to a fixation part 30 (FIGS. 2 to 4), to be rotatable about an axis J11. The shaft 11 supported by the bearing 15 varies in inclination with respect to the horizontal direction (or Y direction) of the axis J11 with the fulcrum 15S that is positioned in the vicinity of the bearing 15. The roll MR is held in such a manner that a holder 12 (see FIG. 5A) installed at the shaft 11 is inserted in the paper tube (core) of the roll MR which serves as the center of rotation. At this time, the roll MR is set at the holder 12 such that a printed surface of the medium PM on which a toner image is formed faces, for example, in the direction of arrow B. The pair of guide plates 13A and 13B are disposed at the opposite ends of the holder 12 in the width direction so as to face each other across the roll MR in the width direction, and serves to guide the edges of the medium PM forwarded from the roll MR. The lock 14 is a mechanism that fixes the roll MR such that the roll MR does not come off from the holder 12 during operation of the image forming apparatus. The shaft 11 is a specific example corresponding to a "second shaft" of the invention. The bearing 15 is a specific example corresponding to a "second holding part" of the invention.

The medium introductory part 2 introduces the medium PM forwarded from the roll MR of the medium feed part 1 to the medium carrying part 3 of the image forming unit D2, and has a shaft 21, a tension roller 22, a feed roller 23, a shaft 24, arms 25A and 25B, a bracket 26 and a bearing 28. The shaft 21 extends in the width direction and is held by the bearing 28, which is fixed to the fixation part 30, to be rotatable about an axis J21. The shaft 21 has two portions (a distal part 211 and a proximal part 212) separably interconnected in the position of the bearing 28. The distal part 211 and the proximal part 212 are separated and connected in the direction of the axis J21. The distal part 211 is held by the bearing 28 to be rotatable about the axis J21. The proximal part 212 is held by the bracket 26 fixed to the fixation part 30 and by a link plate 31 to be described later. As shown in FIG. 7A, the end of the proximal part 212 opposite from the distal part 211 (a proximal end 21B of the shaft 21) is biased by a spring 29 in the direction approaching the distal part 211 (in the left direction indicated by arrow in FIG. 7A) during operation of the image forming apparatus. The spring 29 is attached to a cap 36 fixed to an outer surface (a surface positioned on the opposite side from the tension roller 22) 31S of the link plate 31 and is able to extend and contract along the axis J21. When the image forming apparatus is not in operation (for example, when the roll MR is changed out), however, a force exceeding the bias force of the spring 29 is applied to the proximal part 212 in the direction opposite from that of the bias force shown in FIG. 7A (in the right direction indicated by arrow in FIG. 7B) as shown in FIG. 7B, whereby the distal part 211 and the proximal part 212 are separated. The medium introductory part 2 has such a mechanism and therefore can establish the state in which the distal part 211 and the proximal part 212 are interconnected (FIG. 7A) to place the arms 25A and 25B and the tension roller 22 downward during operation shown in FIG. 7C and the state in which, after the distal part 211 and the proximal part 212 are separated (FIG. 7B), the arms 25A and 25B and the tension roller 22 are flipped upward as shown in FIG. 7D in, for instance, changing the roll MR.

The shaft 21 supported by the bearing 28 varies in inclination with respect to the horizontal direction of the axis J21 with the fulcrum 26S that is positioned in the vicinity of the bearing 28. The shaft 21 is a specific example corresponding to a "first shaft" of the invention. The bearing 28 is a specific example corresponding to a "first holding part" of the invention. The shaft 24 is a specific example corresponding to a "fourth shaft" of the invention.

The tension roller 22 is a member that is provided to surround the shaft 21 partially in the width direction, comes into contact with the medium PM forwarded from the medium feed part 1 and imparts a predetermined bias force to the medium PM downward in the vertical direction, for example. A load is to be applied to the tension roller 22 by, for instance, a rotational force of the arms 25A and 25B about the shaft 24. The tension roller 22 serves to prevent the slack of the medium PM by imparting tension to the medium PM between the medium feed part 1 and the feed roller 23. In addition, the tension roller 22 lies between the medium feed part 1 and the feed roller 23 to thereby serve to stabilize the attitude of the medium PM with respect to the feed roller 23. If the tension roller 22 is not provided, the tension of the medium PM between the medium feed part 1 and the feed roller 23 and the entry angle of the medium PM with respect to the feed roller 23 are to sequentially vary because the roller MR in the medium feed part 1 decreases in diameter according to the usage. Imparting substantially constant tension to the medium PM using the tension roller 22 makes it possible to keep the entry angle of the medium PM with respect to the feed roller 23 substantially constant. Thus, the tension roller 22 contributes to stable running of the medium PM. The tension roller 22 is a specific example corresponding to a "first bias member" of the invention.

The feed roller 23 is a member that is a rotational body rotating about the shaft 24 whose one end is rotatably held at the fixation part 30 and that feeds the medium PM, which has reached from the medium feed part 1 through the tension roller 22, to the medium carrying part 3.

The shaft 24 is held at the fixation part 30. The arms 25A and 25B face each other across the tension roller 22 and each include one end that is rotatably held at the shaft 24 and the other end that rotatably holds the shaft 21 (see FIGS. 3, 5A and 5C, for example). At the other end of the arm 25A, the shaft 21 is held to be movable along the direction in which the tension roller 22 biases the medium PM (e.g., vertical direction or −Z direction). To be more specific, as shown in FIGS. 6A and 6B, a long hole 25AK is provided at the other end of the arm 25A to extend in the vertical direction, and an end of the shaft 21 having a substantially circular cross section is inserted in the long hole 25AK. Owing to this configuration, the end 21A of the shaft 21 is movable upward and downward in the vertical direction that is the longitudinal direction of the long hole 25AK.

The medium feed unit D1 is further provided with the link plate 31, a shaft 32, a spring 34 and a bracket 35.

The link plate 31 is a member that links the shaft 11 with the shaft 21. The link plate 31 is a plate member that is displaceable with respect to the fixation part 30 such that the inclination angle of the shaft 21 with respect to the fixation part 30 varies in accordance with change of the inclination angle of the shaft 11 with respect to the fixation part 30. The link plate 31 is positioned on the opposite side of the fixation part 30 from both of the medium feed part 1 and the medium introductory part 2 and holds a proximal end 11B of the shaft 11 and the proximal end 21B of the shaft 21. The link plate 31 is a specific example corresponding to a "link member" of the invention.

Figure 9:
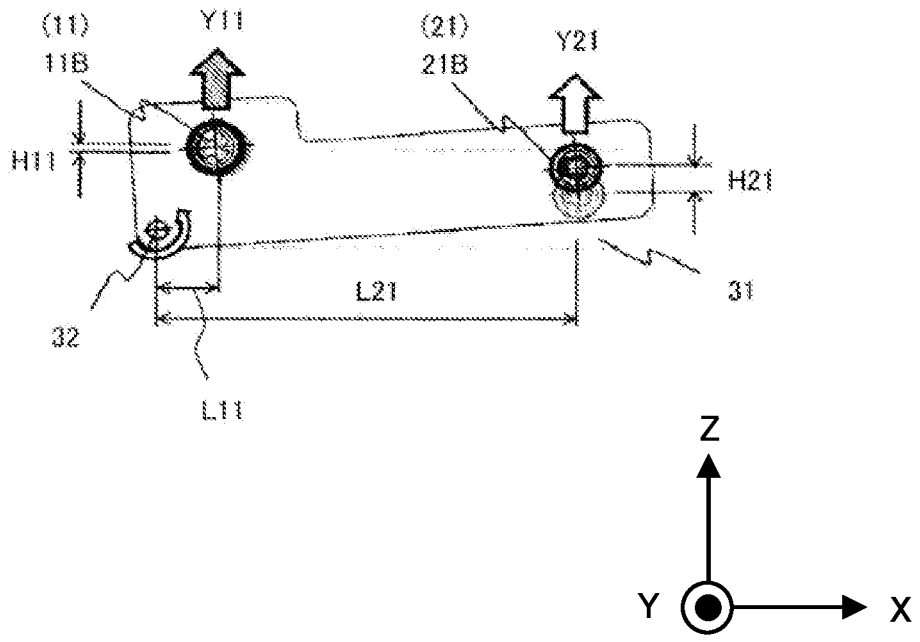
FIG. 9 is a rear view showing the appearance and function of an important portion of the medium feed unit shown in FIG. 1.

The shaft 32 is a member that connects the fixation part 30 with the link plate 31 and holds the link plate 31 such that the link plate 31 is rotatable with respect to the fixation part 30. As shown in FIG. 9 which will be referred to later, in the link plate 31, a horizontal distance L21 between the shaft 21 and the shaft 32 is preferably larger than a horizontal distance L11 between the shaft 11 and the shaft 32. In addition, the shaft 11 is preferably positioned between the shaft 21 and the shaft 32 in the horizontal direction. FIG. 9 is a rear view showing the appearance and movement of the link plate 31 as well as its vicinity.

The spring 34, see FIGS. 4 and 5A, is a member that biases a part of the link plate 31, for instance, downward in a position away from the shaft 32 in the horizontal direction. The spring 34 includes one end that is fixed to, for example, the fixation part 30 and the other end that abuts a part of the link plate 31. The spring 34 biases the proximal end 11B of the shaft 11 and the proximal end 21B of the shaft 21 downward via the link plate 31. The spring 34 is a specific example corresponding to a "second bias member" of the invention.

The bracket 35 is a member that is fixed to the fixation part 30 and rotatable holds the shaft 32.

Operation and Effect (A. Print Action)

In the image forming apparatus, printing (formation of a toner image) on the medium PM is carried out as described below.

Specifically, first, when the leading edge of the medium PM pulled out from the roll MR held at the holder 12 is inserted in a medium insertion port 3K through the tension roller 22 as shown in FIG. 1, the leading edge detection sensor 301 detects the leading edge of the medium PM. Consequently, the forwarding roller pair 302 starts rotating to forward the medium PM from the roller MR in a feed direction A, and the medium PM is carried to the medium cutting part 4 located downstream. The feed direction A of the medium PM is set to form a predetermined entry angle θ with respect to the horizontal direction at a contact point with, for example, the tension roller 22 (see FIG. 1). When the leading edge of the medium PM forwarded from the forwarding roller pair 302 is detected by the leading edge detection sensor 303, the roller pair 403 is driven. The medium PM carried to the medium cutting part 4 is cut at a given length and further carried to the write-in timing adjustment carrying part 5 located downstream. The medium PM carried to the write-in timing adjustment carrying part 5 is then carried, at the appropriate timing, to the secondary transfer part in which the secondary transfer backup roller 704 and the secondary transfer roller 707 face each other.

In the image forming part 6 and the intermediate transfer unit 7, toner images of respective colors are formed through a electrophotographic process described below. Specifically, the surface of a photosensitive drum is uniformly charged by a charge roller that is supplied with, for instance, a predetermined application voltage. Subsequently, the surface of the photosensitive drum is irradiated with irradiation light emitted from an LED head and exposed to the light, whereby an electrostatic latent image corresponding to a print pattern is formed on the photosensitive drum. Further, each toner is supplied through a development roller and adheres to the electrostatic latent image on the photosensitive drum. The toner (toner image) on the photosensitive drum is transferred to the surface of the intermediate transfer belt 701 by the aid of an electric field between the drum and the primary transfer roller 705 facing thereto. Thereafter, the tone image on the surface of the intermediate transfer belt 701 is transferred to the medium PM.

Subsequently, the toner (toner image) on the medium PM is fused upon application of heat and pressure in the fuser part 8. The medium PM on which the toner has been fused is ejected to the outside of the image forming unit D2 through the ejection carrying part 9.

(B. Operation and Action of Medium Feed Unit D1)

Figure 8A:
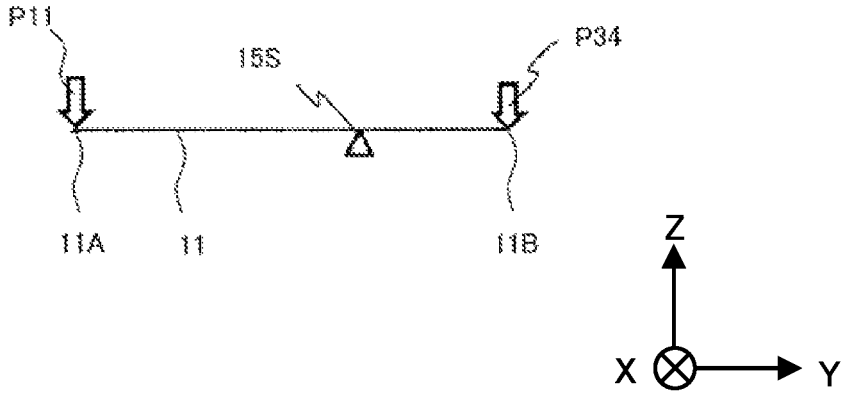
FIG. 8A is a conceptual view for illustrating an action of the medium feed part shown in FIG. 1.
Figure 8B:
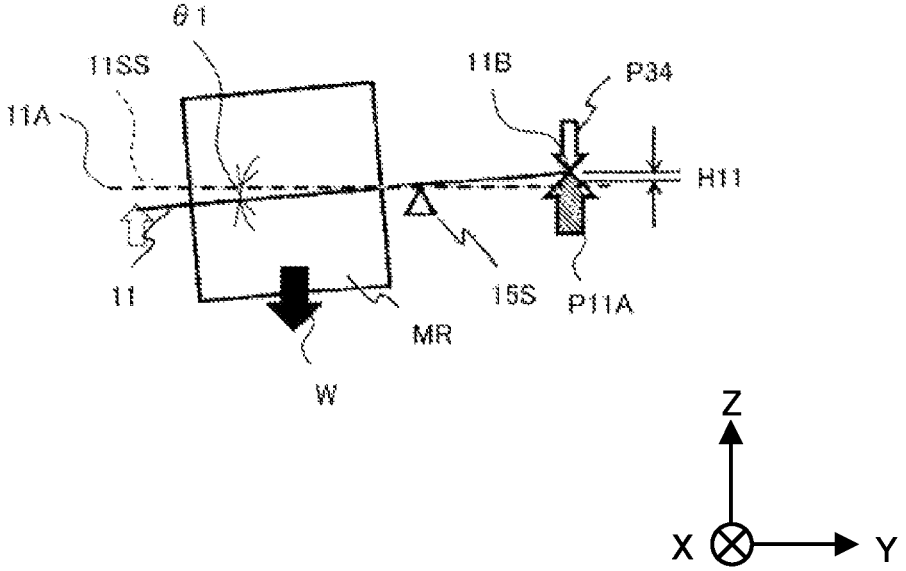
FIG. 8B is another conceptual view for illustrating an action of the medium feed part shown in FIG. 1.

In the initial state where the roll MR is not installed on the holder 12, as shown in FIG. 8A, the shaft 11 is maintained in the horizontal direction and is in an equilibrium state. When the roll MR is installed on the holder 12, as shown in FIG. 8B, the shaft 11 inclines so as to go further downward as it goes away from the link plate 31, i.e., as it approaches the distal end 11A, with the bearing 15 (fulcrum 15S) being taken as the starting point. On the other hand, the shaft 11 inclines such that the proximal end 11B goes upward as it approaches the link plate 31 with the bearing 15 (fulcrum 15S) being taken as the starting point. Thus, the shaft 11 is inclined at an inclination angle θ1 with respect to the horizontal direction 11SS such that the height position of the distal end 11A is higher than that of the proximal end 11B. The mechanism of inclination of the shaft 11 is as follows: The weight W of the roll MR is added to the portion between the fulcrum 15S and the distal end 11A and accordingly, a force 11A directed from top to bottom is exerted on the proximal end 11B of the shaft 11. Consequently, the force P11A exerted on the distal end 11A of the shaft 11 and a force P34 exerted on the proximal end 11B of the shaft are unbalanced and the shaft 11 is in a disequilibrium state. As a result, the proximal end 11B is displaced by a displacement amount H11. FIGS. 8A and 8B are conceptual views for illustrating actions of the medium feed part 1. FIG. 8A illustrates the shaft 11 in the equilibrium state, while FIG. 8B illustrates the shaft 11 in the disequilibrium state.

Figure 10A:
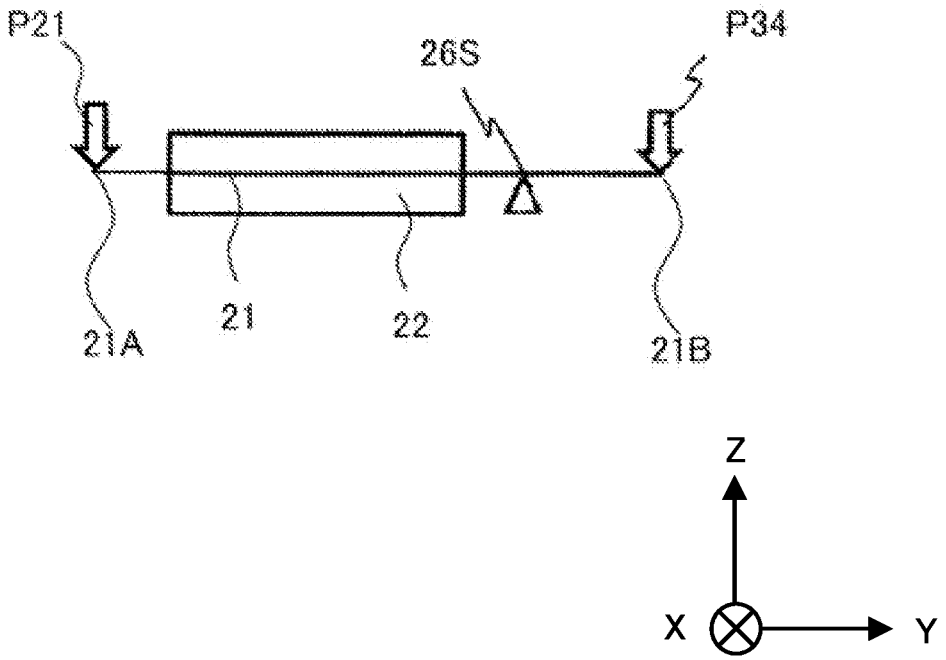
FIG. 10A is a conceptual view for illustrating an action of the medium introductory part shown in FIG. 1.

In the initial state where the roll MR is not installed on the holder 12, as shown in FIG. 10A, the horizontal condition is established in which the shaft 21 and the tension roller 22 are maintained in the horizontal direction. FIG. 10A is a conceptual view for illustrating an action of the medium introductory part 2 and represents the shaft 21 in the initial state.

If the medium PM forwarded from the medium feed part 1 is carried to the feed roller 23 with the shaft 21 of the tension roller 22 of the medium introductory part 2 being held in the horizontal direction while the medium feed part 1 is in the disequilibrium state, i.e., the shaft 11 is inclined, the medium PM is skewed. This occurs because the shaft 11 and the shaft 21 has a geometrical relationship of skew lines and therefore, tension applied to one end of the medium PM and tension applied to the other end thereof in the width direction are to vary. For example, when the medium PM that has been forwarded with the distal end 11A of the shaft 11 being positioned lower than the proximal end 11B thereof as shown in FIG. 8B is fed to the tension roller 22 in the horizontal state, the path length along the medium PM from the position of the roll MR on the distal end 11A side to the tension roller 22 is to be longer than the path length along the medium PM from the position of the roll MR on the proximal end 11B side to the tension roller 22. Consequently, stronger tension occurs, in the medium PM forwarded from the roll MR, at a position on the distal end 11A side associated with the longer path length. As a result, the medium PM is skewed toward the distal end 11A side of the shaft 11 when traveling to the tension roller 22.

One possible measure to solve this problem is to incline the tension roller 22 (shaft 21) in accordance with the inclination angle θ1 of the shaft 11 in advance in order to avoid skewing of the medium PM as above. However, the roll MR decreases in weight according to the usage of the medium PM. That is, the roll MR1 with a large winding amount shown in FIG. 2 is different in weight from the roll MR2 with a small winding amount also shown in FIG. 2. Accordingly, the inclination angle θ1 (FIG. 8B) changes (decreases) with changing (decreasing) winding amount of the roll MR. Since the relationship in magnitude of angle between the inclination angle θ1 and the inclination angle of the tension roller 22 (shaft 21) varies, the degree and direction of skewing gradually vary accordingly, which sometimes makes it difficult to sufficiently suppress skewing.

Figure 10B:
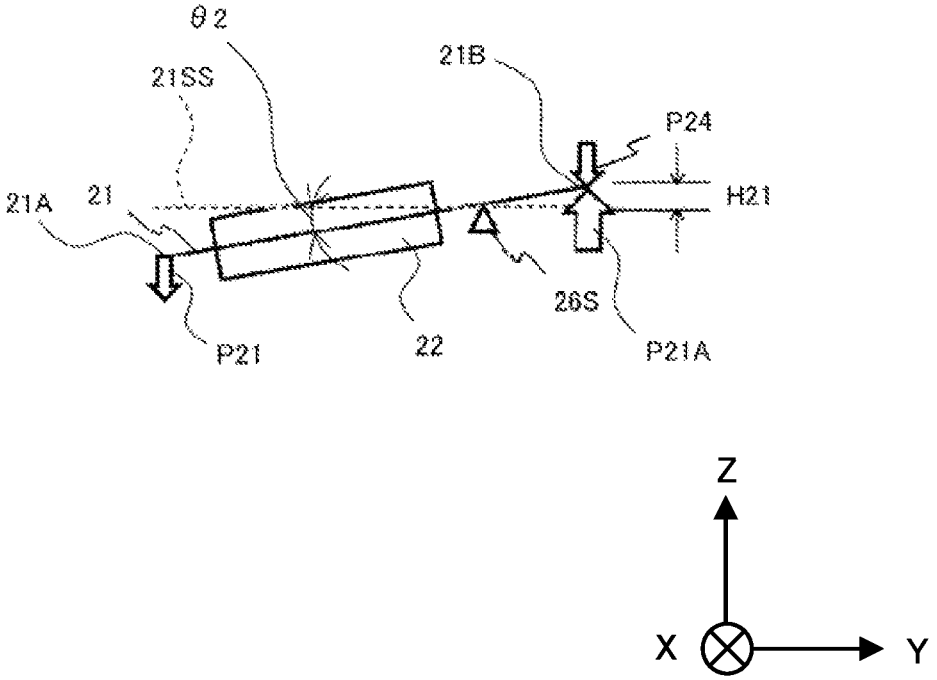
FIG. 10B is another conceptual view for illustrating an action of the medium introductory part shown in FIG. 1.

To cope with it, the link plate 31 is employed in the medium feed unit D1 of the embodiment. In the initial state where the roll RM is not installed on the holder 12, the shaft 21 and the tension roller 21 are maintained in the horizontal direction and is in the horizontal state (FIG. 10A). In this state, a load (force P21) caused by the self-weight of the tension roller 22 and other factors and applied to the distal end 21A and a load (force P34) caused by the spring 34 and applied to the proximal end 21B are balanced with the fulcrum 26S. In the medium feed unit D1 of the embodiment, when the disequilibrium state is established, the link plate 31 is rotated counterclockwise with the center at, for instance, the shaft 32, as shown in FIG. 9. This occurs because the proximal end 11B of the shaft 11 is displaced by a displacement amount H11 in the direction of arrow Y11. This rotational movement of the link plate 31 causes the proximal end 21B of the shaft 21 fixed to the same link plate 31 to be also displaced by a displacement amount H21 in the direction of arrow Y21. In this state, the horizontal distance L21 between the shaft 21 and the shaft 32 is larger than the horizontal distance L11 between the shaft 11 and the shaft 32 and therefore, the displacement amount H21 is larger than the displacement amount H11. FIG. 10B shows the shaft 21 in the disequilibrium state. Due to the rotational movement of the link plate 31, a force P21A is applied from underneath to the proximal end 21B to lift up the proximal end 21B by the displacement amount H21 while displacing the distal end 21B downward. Thus, the shaft 21 is to be inclined by an inclination angle θ2 (or the first inclination angle) with respect to the horizontal direction 21SS.

These inclination angles θ1, θ2 may be determined with respect to a medium carrying path that is a plane on which the medium is carried to the downstream, or these angles may be determined in the X direction view, which is a perpendicular direction against Z-Y plane.

(C. Effect) 1

As described above, in the medium feed unit D1 of the embodiment, owing to the link plate 31, the shaft 21 (tension roller 22) of the medium introductory part 2 is inclined in conjunction with inclination of the shaft 11 of the medium feed part 1. Consequently, a difference between the path length along the medium PM from the position of the roll MR on the distal end 11A side to the tension roller 22 and the path length along the medium PM from the position of the roll MR on the proximal end 11B side to the tension roller 22 is sufficiently reduced. As a result, a difference between tension applied to one end of the medium PM in the width direction and tension applied to the other end thereof in the width direction can be sufficiently reduced. In addition, in this embodiment, the inclination angle θ2 of the shaft 21 appropriately changes in accordance with change of inclination angle θ1 (the second inclination angle) of the shaft 11. Therefore, a difference in tension between opposite sides of the roll MR in the width direction is appropriately controlled in accordance with decrease in the winding amount (weight) of the roll MR.

When, for example, the inclination angle θ2 is made slightly larger than the inclination angle θ1, this functions to push the medium PM such that the medium PM approaches the guide plate 13B. Likewise, When the inclination angle θ2 is made slightly smaller than the inclination angle θ1, this functions to push the medium PM such that the medium PM approaches the guide plate 13A. Thus, by making the inclination angle θ1 and the inclination angle θ2 slightly different, the medium PM can be slightly skewed, and this enables stable running of the medium PM while making one end of the medium PM be in slight contact with either one of the guide plates 13A and 13B. At this time, since a difference between the inclination angle θ1 and the inclination angle θ2 can be controlled using the link plate 31, it is possible to avoid malfunctions such as folding of the medium PM that may occur when one end of the medium PM comes into contact with the guide plate 13A or 13B too strongly.

In this embodiment, when the shaft 11 is set horizontal (or second inclination angle θ1 is nearly zero), the first inclination angle θ2 inclines at about 0.45°. The angle difference (Δ) between the first and second angles θ1 and θ2 is 0.45°. In the invention, the angle difference is preferred to be in a range from 0.1° to 0.6°. With the link plate 31, the medium fed from the roll is prevented from winding to some degrees so that the medium is not pressed much against one of the g guide plates. Accordingly, a drawback that the medium is folded by being pressed against the guide plate during the carry is eliminated. The angle difference is designed by proportions of ratios of W11$p$/W11$d$ (see FIG. 5B), W21$p$/W21$d$ (see FIG. 5C), L11/L21 (see FIG. 9) and proper distance between shafts 11 and 21.

Owing to the above configuration, the medium feed unit D1 of the embodiment can appropriately limit skewing of the medium PM forwarded from the medium feed part 1, thereby feeding the medium PM more stably. Therefore, the image forming apparatus having the medium feed unit D1 can form an excellent image in a predetermined position of the medium PM.

ALTERNATIVE EXAMPLES

While the invention is explained with several embodiments, the invention is not limited thereto and various modifications are possible.

For instance, while the image forming apparatus forming color images is explained in the above embodiment, the invention is not limited thereto and may be applied to an image forming apparatus that transfers, for example, only a black toner image to form a monochromatic image color image.

While the LED head having a light emitting diode is used as an exposure part that is a light source in the above embodiment, the light source may be, for instance, a laser element or the like.

While, in the above embodiment, the direction of the axis J11 of the shaft 11 and that of the axis J21 of the shaft 21 (the outer peripheral surface of the tension roller 22) are held in the horizontal direction in the state where the roll MR is not installed on the holder 12, that is, in the initial state, the invention is not limited thereto. In the initial state, the direction of the axis J11 of the shaft 11 and that of the axis J21 of the shaft 21 may be inclined with respect to the horizontal direction. Besides, in the initial state, the direction of the axis J11 of the shaft 11 and that of the axis J21 of the shaft 21 may be substantially parallel or non-parallel to each other.

While, in the above embodiment, the medium introductory part 2 has the tension roller 22 to impart a predetermined bias force to the medium PM, the invention may be configured to use, instead of the tension roller 22, a guide roller that only guides the medium PM along the route.

While, in the above embodiment, the image forming apparatus having print function is explained as a specific example of the "image forming unit" of the invention, the invention is not limited thereto. Specifically, the invention may be applied to an image forming unit that serves as a multifunction machine having, in addition to such print function, for instance, scan function, FAX function or image display function.

Re: Ratio of L11/L12

In the embodiment illustrated in FIG. 9, when H11 is 0.2 mm and H21 is to be 0.6 mm to 1 mm. The ratio of L11/L12 is preferred to be ranged from ⅕ to ⅓.

Re: Ratios of W11$p$/W11$d$, W21$p$/W21$d$

FIG. 5B illustrates distances W11$p$ and W11$d$. Distance W11$p$ is determined between the link plate 31 and the fulcrum 15S along the axis direction of shaft 11. Distance W11$d$ is determined between the fulcrum 15S and the guide plate 13$a$ along the axis direction. The range of W11$p$/W11$d$ is preferred to be around ½ and practically to be ranged from ⅓ to ⅔.

FIG. 5B illustrates distances W21$p$ and W21$d$. Distance W21$p$ is determined between the link plate 31 and the fulcrum 26S along the axis direction of shaft 21. Distance W21$d$ is determined between the fulcrum 26S and the end 21A of the shaft along the axis direction. The range of W21$p$/W21$d$ is preferred to be ½ and practically to be ranged from ¼ to ⅔. A position of end 21A corresponds to a position of guide plate 13A in a direction in which the medium is carried. As shown in the figures, the ratio of W11$p$/W11$d$ may be larger than the ratio of W21$p$/W21$d$.

The weight of shaft 11 is, for example, 350 gf. The weight of the medium roll, which is new, is about 3 kgf, which is 8 to 9 times larger than the shaft 11. As the medium is fed from the roll, the weight of the roll decreases. When coming to nearly end, the roll weights about 200 gf, which is one tenth or smaller than the new one's weight. When the roll is newly installed to shaft 11, the weight of the roller may be equal to that of the shaft, and is preferably 5 to 10 times larger that that of shaft 11.

What is claimed is:

1. A medium feed unit that is to be installed in an image forming apparatus having an image forming unit and feeds a medium, which is fed from a medium roll, to the image forming unit, the medium feed unit, comprising:

a medium introductory part that includes a first shaft and introduces the medium to the image forming unit;

a medium feed part that includes a second shaft around which the medium roll rotates and feeds the medium to the medium introductory part;

a fixation part that includes a first holding part holding the first shaft and a second holding part holding the second shaft; and a link member that links the first shaft with the second shaft and is displaceable with respect to the fixation part such that a first inclination angle (θ2) of the first shaft with respect to the fixation part varies in accordance with a variation of a second inclination angle (θ1) of the second shaft with respect to the fixation part.

2. The medium feed unit according to claim 1, wherein the fixation part is sandwiched between the link member and both of the medium introductory part and the medium feed part, and the link member is positioned on an opposite side of the fixation part from both of the medium introductory part and the medium feed part.

3. The medium feed unit according to claim 2, wherein when a medium roller that is formed with the medium being in a roll shape is installed in the first shaft, the first shaft inclines at the first inclination angle such that the first shaft goes further downward as it goes away from the link member with the first holding part being taken as a starting point, the second shaft inclines at the second inclination angle such that the second shaft goes further downward as it goes away from the link member with the second holding part being taken as a starting point, and the first inclination angle is larger than the second inclination angle.

4. The medium feed unit according to claim 1, further including:

a third shaft that connects the link member with the fixation part and holds the link member such that the link member is rotatable around the third shaft.

5. The medium feed unit according to claim 4, wherein the link member is configured such that a first horizontal distance (L21) between the first shaft and the third shaft is larger than a second horizontal distance (L11) between the second shaft and the third shaft.

6. The medium feed unit according to claim 5, wherein the second shaft is positioned between the first shaft and the third shaft in a horizontal direction.

7. The medium feed unit according to claim 1, wherein the medium introductory part has a first bias member that biases the medium in a first direction.

8. The medium feed unit according to claim 7, further including:

a fourth shaft held at the fixation part; and a first arm and a second arm each of which includes one end rotatably held at the fourth shaft and the other end rotatably holding the first shaft, the first arm and the second arm facing each other across the medium introductory part, wherein the first shaft is held at the other end of the first arm to be movable in the first direction.

9. The medium feed unit according to claim 1, further including:

a second bias member that biases the link member downward.

10. An image forming apparatus, comprising an image forming unit and a medium feed unit that feeds a medium to the image forming unit from a medium roll, wherein the medium feed unit that is to be installed in the image forming apparatus having the image forming unit, the medium feed unit comprises:

a medium introductory part that includes a first shaft and introduces the medium to the image forming unit;

a medium feed part that includes a second shaft around which the medium roll rotates and feeds the medium to the medium introductory part;

a fixation part that includes a first holding part holding the first shaft and a second holding part holding the second shaft; and a link member that links the first shaft with the second shaft and is displaceable with respect to the fixation part such that a first inclination angle of the first shaft with respect to the fixation part varies in accordance with a variation of a second inclination angle of the second shaft with respect to the fixation part.

* * * * *